United States Patent [19]

Kelham

[11] Patent Number: 4,902,397

[45] Date of Patent: Feb. 20, 1990

[54] ELECTROLYTIC CELL WITH DIFFERENTIAL GAS PRESSURE CONTROL DEVICE

[75] Inventor: Stephen F. Kelham, Warrington, England

[73] Assignee: Imperial Chemical Industries PLC, London, England

[21] Appl. No.: 209,941

[22] Filed: Jun. 22, 1988

[30] Foreign Application Priority Data

Jun. 25, 1987 [GB] United Kingdom ..... 8714903

[51] Int. Cl.[4] ..... C25B 9/00; C25B 15/08

[52] U.S. Cl. ..... 204/256; 204/258; 204/266; 204/279

[58] Field of Search ..... 204/256, 258, 265, 266, 204/279

[56] References Cited

U.S. PATENT DOCUMENTS

| | | | |
|---|---|---|---|
| 1,230,803 | 6/1917 | Sebille | 204/256 X |
| 2,695,874 | 11/1954 | Zoansky | 204/258 |
| 3,330,755 | 7/1967 | Mahany | 204/258 X |
| 3,929,148 | 12/1975 | Midy | 137/84 |
| 4,254,790 | 3/1981 | Eriksson | 137/100 |
| 4,323,442 | 4/1982 | Lantin et al. | 204/258 X |
| 4,698,144 | 10/1987 | Wainerdi | 204/265 X |

FOREIGN PATENT DOCUMENTS

| | | |
|---|---|---|
| 597180 | 12/1929 | Fed. Rep. of Germany . |
| 473103 | 10/1937 | United Kingdom . |

*Primary Examiner*—Donald R. Valentine

*Attorney, Agent, or Firm*—Cushman, Darby & Cushman

[57] ABSTRACT

A differential gas pressure control device for an electroylytic cell which comprises an anode compartment in which in operation a gas is generated, a cathode compartment in which in operation a gas is generated, a pipe leading from the anode compartment(s) of the cell through which in operation anode gas passes, and a pipe leading from the cathode compartment(s) of the cell through which in operation cathode gas passes, in which the control device comprises a movable flow controller positioned so as to control the flow of anode gas in the pipe and a moveable flow controller positioned so as to control the flow of cathode gas in the pipe, in which the flow controllers are operatively connected, and in which in operation the anode and cathode gases independently act upon the flow controllers which control the flow of cathode gas and of anode gas respectively.

10 Claims, 2 Drawing Sheets

ELECTROLYTIC CELL WITH DIFFERENTIAL GAS PRESSURE CONTROL DEVICE

Figure 1:
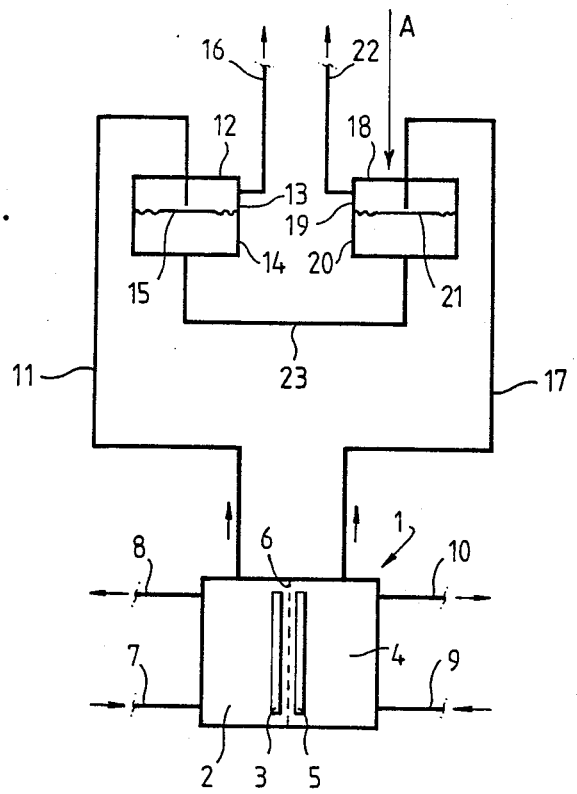

This invention relates to a differential gas pressure control device for use with an electrolytic cell which comprises an anode compartment in which a gas is generated and a cathode compartment in which a gas is generated. The differential pressure control device is particularly suitable for use with an electrolytic cell in which chlorine and hydrogen are generated in the anode and cathode compartments respectively of the cell by the electrolysis of aqueous alkali metal chloride solution, although use of the control device is not restricted to cells used for such electrolysis and it may be used with any electrolysis in which gases are generated in the anode and cathode compartments of the cell, eg in the electrolysis of water in which oxygen is generated in the anode compartments and hydrogen is generated in the cathode compartments.

Electrolytic cells are known comprising an anode or a plurality of anodes and a cathode or a plurality of cathodes with each anode being separated from the adjacent cathode by a separator which divides the electrolytic cell into separate anode and cathode compartments. The anode compartments of such a cell are provided with means for charging electrolyte to the cell, suitably from a common header, and with means for removing products of electrolysis from the cell. Similarly, the cathode compartments of the cell are provided with means for removing products of electrolysis from the cell, and optionally with means for charging water or other fluids to the cell, suitably from a common header.

In such electrolytic cells the separator may be a porous hydraulically permeable diaphragm or it may be a substantially hydraulically impermeable ionically permselective membrane, e.g. a cation permselective membrane.

Such electrolytic cells are used on a vast scale throughout the world to produce gaseous chlorine, gaseous hydrogen, and aqueous alkali metal hydroxide solution by the electrolysis of aqueous alkali metal chloride solution.

Where aqueous alkali metal chloride solution is electrolysed in an electrolytic ell of the diaphragm type the solution is charged to the anode compartments of the cell, gaseous chlorine produced by electrolysis is removed from the anode compartments, depleted solution passes through the diaphragms to the cathode compartments of the cell, and gaseous hydrogen and alkali metal hydroxide produced by reaction of alkali metal ions with water are removed from the cathode compartments, the alkali metal hydroxide being in the form of an aqueous solution which also contains alkali metal chloride.

Where aqueous alkali metal chloride solution is electrolysed in an electrolytic cell of the membrane type the solution is charged to the anode compartments of the cell and gaseous chlorine produced in the electrolysis and depleted alkali metal chloride solution are removed from the anode compartments, alkali metal ions are transported across the membranes to the cathode compartments of the cell to which water or dilute alkali metal hydroxide solution is charged, and gaseous hydrogen and alkali metal hydroxide solution produced by the reaction of alkali metal ions with water are removed from the cathode compartments of the cell.

In such electrolytic cells the operational life of the separator is governed to some extent by the absolute pressures of the gases produced in the anode and cathode compartments of the cell, but it is governed in particular by the differential pressure between these gases, and by variations of this differential pressure.

This is particularly the case where the separator is an ionically permselective membrane. For example, in an electrolytic cell which is equipped with such a membrane and in which gaseous chlorine and hydrogen are produced by the electrolysis of aqueous alkali metal chloride solution optimum membrane life and performance is obtained when the hydrogen gas pressure in the cathode compartments of the cell slightly exceeds the chlorine gas pressure in the anode compartments of the cell. This differential pressure forces the membranes towards the anodes of the electrolytic cell and reduces the amount of movement of the membranes. Movement of the membranes, which may be caused by variations in this differential pressure, and in particular excessive movement of the membranes which may be caused by reversal of the differential pressure, may result in mechanical or chemical damage to the membranes. Such mechanical damage may take the form of pin-holes, cracks or blisters in the membrane, or it may even result in complete rupture of the membrane and consequent mixing of the gaseous hydrogen and chlorine with potentially dangerous consequences. Although use of a high differential pressure of hydrogen over chlorine would cause the membranes to be firmly positioned against the anodes the use of such a high differential pressure is not acceptable as forcing the membranes firmly against the anodes may itself result in damage to the membranes.

Where the separator is a porous hydraulically permeable diaphragm it is particularly important to maintain the desired differential gas pressure in order to minimise or prevent passage of gases across the diaphragm and consequent mixing of hydrogen and chlorine.

In conventional practice the differential pressure between the gases produced in the anode and cathode compartments of an electrolytic cell is controlled by converting the gas pressures into an electronic signal by means of transducers, processing the signals in a control device which generates a corrective signal, and passing the corrective signal to an appropriate control transducer which may, for example, control appropriate valve means operation of which restores the differential pressure to the desired value. Such a control system may operate in a step-wise manner, that is a step-wise rather than a continuous change in differential gas pressure may be effected, and there may be a finite time delay between a change in differential pressure and correction thereof. However, in operation of some electrolytic cells there is a need for a rapidly acting control means which provides a virtually continuous control of the differential gas pressure in order that any undue time delay in the correction of a change in differential gas pressure should not result in damage to the separator in the electrolytic cell, which is particularly necessary where the separator is an ion-exchange membrane, or in undesirable mixing of gases.

The present invention provides a differential gas pressure control device which is responsive to variations in the pressures of the gases produced in both the anode and cathode compartments of an electrolytic cell, which is essentially simple in construction and in operation, and which provides a rapid corrective response to any change in the differential gas pressure from the desired value of the differential gas pressure.

According to the present invention there is provided a differential gas pressure control device for an electrolytic cell which cell comprises at least one anode compartment containing at least one anode at which in operation a gas is generated, at least one cathode compartment containing at least one cathode at which in operation a gas is generated, a separator positioned between each anode and adjacent cathode, a pipe leading from the anode compartment(s) of the cell through which in operation anode gas passes, and a pipe leading from the cathode compartment(s) of the cell through which in operation cathode gas passes, in which the control device comprises a moveable flow controller positioned so as to control the flow of anode gas in said pipe and a moveable flow controller positioned so as to control the flow of cathode gas in said pipe, in which the flow controllers are operatively connected, and in which in operation the anode and cathode gases independently act upon the flow controllers which control the flow of cathode gas and of anode gas respectively.

In operation of the differential gas pressure control device of the invention the gas which is produced in the cathode compartment(s) of the electrolytic cell, that is the cathode gas, acts independently upon the moveable flow controller which controls the flow of gas which is generated in the anode compartment(s) of the electrolytic cell, that is the anode gas. Similarly, the gas which is produced in the anode compartment(s) of the electrolytic cell, that is the anode gas, acts independently upon the moveable flow controller which controls the flow of gas which is generated in the cathode compartment(s) of the electrolytic cell, that is the cathode gas. Thus, for example, when the pressure of the anode gas which is produced in the electrolytic cell rises relative to the pressure of the cathode gas such that the differential between the pressures of the anode gas and cathode gas rises above the desired value the anode gas acts upon the flow controller which controls the flow of cathode gas so as to restrict the flow of cathode gas and cause a rise in the pressure of cathode gas produced in the electrolytic cell thereby restoring the differential pressure between the anode and cathode gases.

Similarly, when the pressure of the cathode gas which is produced in the electrolytic cell rises relative the pressure of the anode gas such that the differential between the pressures of the anode gas and cathode gas decreases below the desired value the cathode gas acts upon the flow controller which controls the flow of anode gas so to restrict the flow of anode gas and cause a rise in the pressure of anode gas produced in the electrolytic cell thereby restoring the differential pressure between the anode and cathode gases to the desired value.

In U.S. Pat. No. 2,695,874 there is described an electrolytic cell which comprises a permeable diaphragm which divides the cell into separate compartments in which hydrogen and oxygen respectively are generated by electrolysis, and which is provided with a control means for maintaining a desired pressure differential between these gases.

The control means comprises two gas separators into which hydrogen and oxygen respectively are discharged and which are connected by a liquid-filled U-tube, a pressure control valve which controls the flow of hydrogen from the gas separator, and a float controlled valve which is in contact with the liquid in the U-tube and which controls the flow of oxygen from the gas separator.

In operation excess pressure of hydrogen in the gas separator causes the pressure control valve to be activated, hydrogen to be released, and the pressure of hydrogen to decrease. Decrease in the hydrogen gas pressure results in flow of liquid in the U-tube towards the hydrogen gas separator with conseqent movement of the float and the valve in the oxygen separator and release of oxygen gas. The consequent decrease in oxygen gas pressure restores the differential gas pressure.

The differential pressure control means of the U.S. patent is quite unlike the device of the present invention.

The flow controllers may comprise at least one flexible membrane, which is desirably non-porous, that is non-permeable to gases generated in the electrolytic cell and with which it comes into contact. It is also desirable that the membrane is resistant to chemical attack by the gases generated in the electrolytic cell. The flexible membrane may, for example, be made of an elastomeric material, the nature of the material being determined by the gases generated in the electrolytic cell. For example, where chlorine is generated by the electrolysis of an aqueous alkali metal chloride solution the membrane may be made of an ethylene-propylene copolymer or an ethylene- propylene-diene copolymer elastomer, but it is preferably made of a fluoropolymer elastomer as such elastomers are especially resistant to chemical attack by chlorine.

The flow controller may be positioned adjacent to the end of a pipe from which the anode gas or the cathode gas issues.

The flow controllers may comprise two such flexible membranes which are positioned, respectively, adjacent to the ends of the pipe from which the anode gas issues and adjacent to the end of the pipe from which the cathode gas issues. Movement of the flexible membrane towards the end of the pipe causes a decrease in the flow of gas, or, where the membrane contacts and seals the end of the pipe, the membrane may even stop the flow of gas, if only momentarily, with a consequent increase in pressure of the gas in the anode compartment(s), or in the cathode compartment(s), of the electrolytic cell and a resultant change in the differential gas pressure.

The operative connection between the flow controllers may be a hydraulic connection, particularly a liquid hydraulic connection. Thus, where the flow controllers comprise two flexible membranes they may be operatively connected hydraulically by means of a hydraulic liquid. For example, the differential pressure control device of the invention may comprise two vessels each of which is partitioned by a flexible membrane, the vessels may be connected by means of a pipe containing a hydraulic liquid which is in contact with the membranes, and each vessel may comprise a pipe leading into the respective vessel and through which anode gas or cathode gas, respectively, may be introduced into the vessel, the end of each pipe being positioned adjacent to a flexible membrane, and each vessel may comprise a pipe through which anode gas, or cathode gas, respectively may be removed from the vessel. In general, the flexible membrane will be positioned generally horizontally across each vessel, the anode gas, or cathode gas, will be introduced into the upper part of the vessel, and the hydraulic liquid will be in the lower part of the vessel.

In an alternative embodiment of the differential gas pressure control device of the invention there is a direct operative connection between the flow controllers. For example, the flow controllers may comprise a single flexible membrane and in operation of the device the anode gas may act upon one side of the membrane in order to control the flow of the cathode gas, and the cathode gas may act upon the other side of the membrane in order to control the flow of the anode gas.

The differential gas pressure control device may comprise a pipe which is divided longitudinally by a flexible membrane thereby providing two passages in the pipe divided from each other by a flexible membrane. Anode gas may be passed along a first passage and cathode gas along a second passage which is divided from the first passage by the flexible membrane. In operation of the device movement of the flexible membrane caused by an increase in the pressure of the cathode gas relative to that of the anode gas results in a decrease in the cross-sectional dimension of the passage carrying the anode gas, and in an increase in the pressure of the anode gas and a restoration of the differential pressure between the anode gas and cathode gas. Similarly, movement of the flexible membrane caused by an increase in the pressure of the anode gas relative to that of the cathode gas results in a decrease in the cross-sectional dimension of the passage carrying the cathode gas, and in an increase in the pressure of the cathode gas and a restoration of the differential pressure between the anode gas and cathode gas.

The desired differential pressure between the anode and cathode gases may be achieved by appropriate positioning of the flow controllers in relation to the pipe in which the anode and cathode gases flow. In the case where aqueous alkali metal chloride solution is to be electrolysed the flow controllers will in general be so positioned as to achieve a slightly higher pressure of cathode gas than of anode gas, that is a differential in the pressure of anode gas to cathode gas of slightly less than one, so that in the electrolytic cell the separator is urged towards the anode and away from the cathode. This is particularly desirable in an electrolytic cell in which an aqueous alkali metal chloride solution is electrolysed, especially where the separator is a cation permselective membrane.

The differential gas pressure control device of the invention may be used with any electrolytic cell in which in use a gas is generated in the anode compartment(s) and a gas is generated in the cathode compartment(s). It is not limited to use with an electrolytic cell in which gaseous chlorine and gaseous hydrogen are produced by electrolysis of aqueous alkali metal chloride solution, e.g. aqueous sodium chloride solution, but it is particularly suitable for use with such an electrolytic cell, and the invention will be described hereafter with reference to such an electrolytic cell.

There is no particular limitation on the design of electrolytic cell with which the differential gas pressure control device of the invention may be used. For example, the electrolytic cell may be a so-called tank-type cell or it may be a cell of the filter press type. The electrolytic cell may be of the monopolar type or the bipolar type. The features of the electrolytic cell with which the pressure control device of the invention may be used will be indicated in general terms only.

In the electrolytic cell the separator may be a hydraulically permeable diaphragm or a substantially hydraulically impermeable ionically permselective membrane, e.g. a cation permselective membrane.

The choice of the material of construction of the separator will depend in part on the nature of the electrolyte, and thus on the products of electrolysis. Where an aqueous solution of alkali metal chloride is to be electrolysed the separator should be resistant to the corrosive products of electrolysis, that is wet chlorine, chlorine-containing aqueous alkali metal chloride solution and aqueous alkali metal hydroxide solution.

Where the separator is a hydraulically permeable diaphragm it may be an asbestos diaphragm or it may be made of a fluorine-containing polymeric material on account of the generally stable nature of such materials in the corrosive environment encountered in many electrolytic cells. Suitable fluorine-containing polymeric materials include, for example, polychlorotrifluoroethylene, fluorinated ethylenepropylene copolymer, and polyhexafluoro-propylene. A preferred fluorine-containing polymeric material is polytetrafluoroethylene on account of its great stability in corrosive electrolytic cell environments, particularly in electrolytic cells for the production of chlorine and alkali metal hydroxide by the electrolysis of aqueous alkali metal chloride solution. Such hydraulically permeable diaphragms are known in the art.

Hydraulically impermeable cation permselective membranes are known in the art and are preferably fluorine-containing polymeric materials containing fixed anionic groups, e.g. carboxylic and/or sulphonic acid groups. Suitable ion exchange membranes are sold under the tradename 'Nafion' by E I DuPont de Nemours and Co Inc and under the tradename 'Flemion' by Asahi Glass Co Ltd.

The anodes in the electrolytic cell may be metallic and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anodes may carry a coating of an electroconducting electrocatalytically-active material. Particularly in the case where an aqueous solution of an alkali metal chloride is to be electrolysed this coating may for example consist of one or more platinum group metals, that is platinum, ruthenium, rhodium, iridium or osmium, and/or an oxide thereof.

The cathodes in the electrolytic cell may be metallic and the nature of the metal will also depend on the nature of the electrolyte to be electrolysed in the electrolytic cell. Where an aqueous solution of an alkali metal chloride is to be electrolysed the cathode may be made, for example, of steel, copper, nickel or copper-coated or nickel-coated steel.

The cathodes may carry a coating of a material which reduces the hydrogen overvoltage at the cathodes when the electrolytic cell is used in the electrolysis of an aqueous solution, e.g. an aqueous alkali metal chloride solution. Such coatings are known in the art.

The anodes and cathodes are provided with means for attachment to a power source. For example, they may be provided with extensions which are suitable for attachment to appropriate bus-bars.

The electrolytic cell is equipped with appropriate means for charging electrolyte and optionally water or other liquid to the cell and with means for removing from the cell the liquid products of electrolysis. These means may be suitable pipework. The electrolytic cell is also equipped with pipework through which the gaseous products of electrolysis may be removed from the anode and cathode compartments of the cell and passed to the differential gas pressure control device of the invention.

Figure 2:
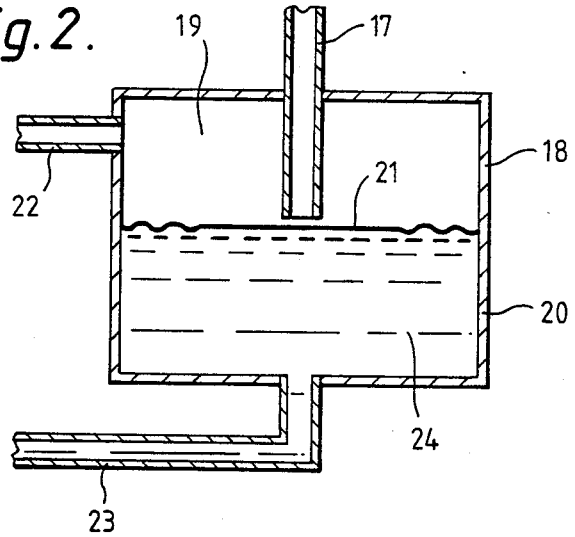
Figure 3:
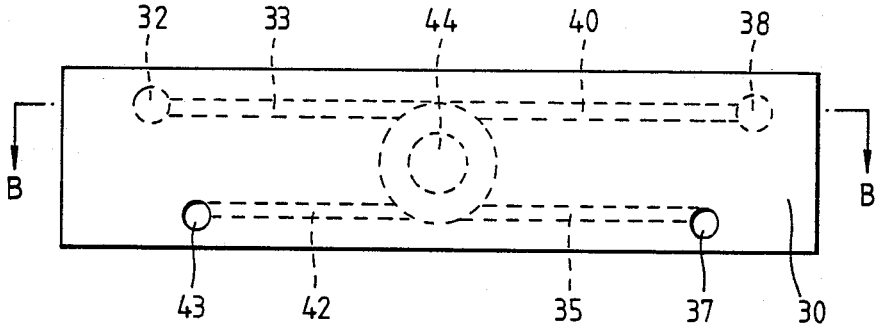
Figure 4:
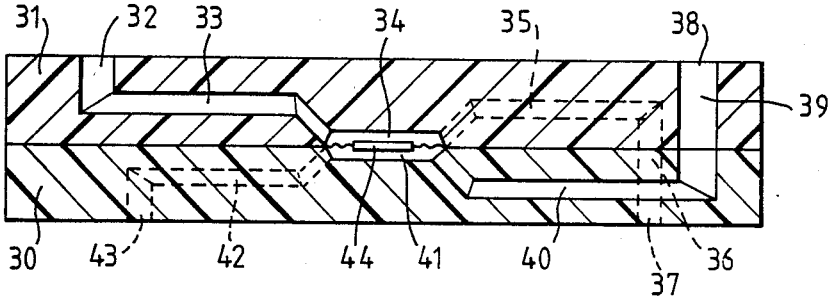

The invention is now described with reference to the following drawings in which FIG. 1 is a diagrammatic representation of an electrolytic cell and of a differential gas pressure control device of the invention, FIG. 2 is a view in cross-section on a larger scale of the part of the differential pressure control device indicated as part A in FIG. 1, FIG. 3 is an end view in elevation of an alternative embodiment of the differential gas pressure control device of the invention, and FIG. 4 is a cross-sectional view of the embodiment of FIG. 3 along the line B-B of FIG. 3.

Referring to FIGS. 1 and 2 there is shown an electrolytic cell 1 which comprises an anode compartment 2 containing an anode 3, and a cathode compartment 4 containing a cathode 5. The anode compartment 2 and the cathode compartment 4 are separated by a cation permselective membrane 6. The anode compartment 2 is provided with a pipe 7 through which electrolyte may be charged to the anode compartment and a pipe 8 through which depleted electrolyte may be removed from the anode compartment. The cathode compartment 4 is provided with a pipe 9 through which liquid may be charged to the cathode compartment and a pipe 10 through which liquid products of electrolysis may be removed from the cathode compartment.

Leading from the anode compartment 2 of the electrolytic cell 1 is a pipe 11 through which gaseous product of electrolysis may be removed from the anode compartment 2. Pipe 11 passes into a vessel 12 which forms a part of the differential gas pressure control device. The vessel 12 is divided into an upper section 13 and a lower section 14 by a non-porous and flexible membrane 15. The membrane 15 is made of a plastic composite material. A pipe 16 leads from the upper part 13 of the vessel 15 and through pipe 16 gaseous product of electrolysis from the anode compartment 2 is passed to a storage vessel (not shown).

Leading from the cathode compartment 4 of the electrolytic cell 1 is a pipe 17 through which gaseous product of electrolysis may be removed from the cathode compartment 4. Pipe 17 passes into a vessel 18 which forms a part of the differential gas pressure control device. The vessel 18 is divided into an upper section 19 and a lower section 20 by a non-porous and flexible membrane 21. The membrane 21 is made of a plastic composite material. A pipe 22 leads from the upper part 19 of the vessel 18 and through pipe 22 gaseous product of electrolysis from the cathode compartment 4 is passed to a storage vessel (not shown).

The elevations of the vessels 12 and 18 may be adjusted relative to each other in order to control the desired differential gas pressure.

The differential gas pressure control device also comprises a pipe 23 which connects the lower part 14 of vessel 12 with the lower part 20 of vessel 18, and the pipe 23 is filled with a hydraulic liquid 24.

In operation of the differential gas pressure control device shown in FIGS. 1 and 2 gaseous product from the anode compartment 2 of the electrolytic cell 1 passes via pipe 11 into the upper part 13 of vessel 12 and then out of vessel 12 via pipe 16 to a storage vessel (not shown). Similarly, gaseous product from the cathode compartment 4 of the electrolytic cell 1 passes via pipe 17 into the upper part 19 of vessel 18 and then out of vessel 18 via pipe 22 to a storage vessel (not shown). When the differential gas pressure between the gaseous products from the anode and cathode compartments is less than the desired value the excess pressure of the gaseous product from the cathode compartment 4 acts on the flexible membrane 21 in vessel 18 and depresses the flexible membrane resulting in an increase in the flow of cathode gas from pipe 17 and a decrease in the pressure of the cathode gas in cathode compartment 4. The movement of flexible membrane 21 is transmitted via hydraulic liquid 23 to flexible membrane 15 in vessel 12 which is caused to rise. Movement of flexible membrane 15 restricts the flow of gaseous product of electrolysis from the anode compartment 2 out of pipe 11 thereby leading to a decrease in the flow of anode gas and an increase in pressure of the anode gas in the anode compartment 2. The desired differential gas pressure is thus restored.

Similarly, when the differential pressure between the gaseous products from the anode and cathode compartments is greater than the desired value the excess pressure of the gaseous product from the anode compartment 2 acts on the flexible membrane 15 in vessel 12 and depresses the membrane resulting in an increase in the flow of the anode gas from pipe 11 and a decrease in the pressure of anode gas in the anode compartment 2. The movement of the flexible membrane 15 is transmitted via hydraulic liquid 23 to flexible membrane 21 in vessel 18 which is caused to rise. Movement of membrane 21 restricts the flow of gaseous product of electrolysis from the cathode compartment 4 out of pipe 17 thereby leading to a decrease in the flow of cathode gas and an increase in pressure of the cathode gas in the cathode compartment 4 and to a restoration of the desired value of the differential gas pressure.

The differential pressure control device shown in FIGS. 3 and 4 is made of two sheets 30, 31 of organic plastics material. The sheet 31 comprises an orifice 32 and a channel 33 leading to a central passage 34. The sheet 31 also has a channel 35 which leads from the central passage 34 and to a channel 36 and orifice 37 in sheet 30. The sheet 31 comprises an orifice 38 and a channel 39 which leads to a channel 40 in sheet 30. Channel 40 leads to a central passage 41. The sheet 30 also has a channel 42 which leads from the central passage 41 to an orifice 43. The central passage 34 is separated from the central passage 41 by a flexible nonporous rubber membrane 44.

The differential gas pressure control device is particularly suitable for use with a filter press type electrolytic cell and in use it may be attached at an end of such a cell with the orifice 32 attached so as to receive gaseous product of electrolysis from the anode compartments of the cell and orifice 38 attached so as to receive gaseous product from the cathode compartments of the cell. In operation gaseous product from the anode compartments of the cell passes into the device through orifice 32, along channel 33 and central passage 34, and thence along channels 35 and 36 and out of the device at orifice 37 to a storage vessel (not shown). Gaseous product from the cathode compartments of the cell passes into the device through orifice 38, along channels 39 and 40 and central passage 41, and thence along channel 42 and out of the device at orifice 43 to a storage vessel (not shown).

When the differential pressure between the gaseous products from the anode and cathode compartments of the electrolytic cell is less than the desired value the excess pressure of the gaseous product from the cathode compartments acts on the flexible membrane 44 in such a way as to move it into centrol passage 34 and restrict the flow of gaseous product from the anode compartments through central passage 34. Restriction of the flow of gaseous product in central passage 34 causes the pressure of the gaseous product in the anode compartments of the electrolytic cell to increase thus restoring the differential gas pressure to the desired value.

Similarly, when the differential pressure between the gaseous products from the anode and cathode compartments of the electrolytic cells is greater than the desired value the excess pressure of the gaseous product from the anode compartments acts on the flexible membrane 44 in such a way as to move it into central passage 41 and restrict the flow of gaseous product from the anode compartments through central passage 41. Restriction of the flow of gaseous product in central passage 41 causes the pressure of the gaseous product in the cathode compartments to increase thus restoring the differential gas pressure to the desired value.

I claim:

1. A differential gas pressure control device for an electrolytic cell which cell comprises at least one anode compartment containing at least one anode at which in operation a gas is generated, at least one cathode compartment containing at least one cathode at which in operation a gas is generated, a separator positioned between each anode and adjacent cathode, a pipe leading from the anode compartment(s) of the cell through which in operation anode gas passes and a pipe leading from the cathode compartment(s) of the cell through which in operation cathode gas passes, in which the control device comprises a moveable flow controller positioned so as to control the flow of anode gas in said pipe and a moveable flow controller positioned to control the flow of cathode gas in said pipe, in which the flow controllers are operatively connected, and in which in operation the anode and cathode gases independently act upon the flow controllers which control the flow of cathode gas and of anode gas respectively.

2. A differential gas pressure control device as claimed in claim 1 in which the flow controllers comprise at least one flexible membrane.

3. A differential gas pressure control device as claimed in claim 2 in which the flexible membrane is positioned adjacent to the end of a pipe from which the anode gas or the cathode gas issues.

4. A differential gas pressure control device as claimed in claim 2 in which the flow controllers comprise two flexible membranes positioned, respectively, adjacent to the ends of the pipe from which the anode gas issues and adjacent to the end of the pipe from which the cathode gas issues.

5. A differential gas pressure control device as claimed in claim 4 in which the operative connection between the flow controllers comprises a hydraulic connection.

6. A differential gas pressure control device as claimed in claim 5 in which the hydraulic connection is a liquid connection.

7. A differential pressure control device as claimed in claim 2 which comprises two vessels each of which is partitioned by a flexible membrane, the vessels are connected by means of a pipe containing a hydraulic liquid which is in contact with the membranes, and each vessel comprises a pipe leading into the respective vessels and through which anode gas or cathode gas, respectively, may be introduced into the vessels, and in which the end of each pipe is positioned adjacent to a flexible membrane.

8. A differential gas pressure control device as claimed in claim 1 in which there is a direct operative connection between the flow controllers.

9. A differential gas pressure control device as claimed in claim 8 in which the flow controller comprises a single flexible membrane in operation of the device the anode gas acting upon one side of the membrane in order to control the flow of the cathode gas, and the cathode gas acting upon the other side of the membrane in order to control the flow of the anode gas.

10. A differential gas pressure control device as claimed in claim 8 which comprises a pipe divided longitudinally by a flexible membrane thereby providing two passages in the pipe divided from each other by the flexible membrane and through which, respectively, anode gas and cathode gas may pass.

* * * * *